US006977490B1

(12) United States Patent
Zhang et al.

(10) Patent No.: US 6,977,490 B1
(45) Date of Patent: Dec. 20, 2005

(54) COMPENSATION FOR LOW DROP OUT VOLTAGE REGULATOR

(75) Inventors: Hong Zhang, Cupertino, CA (US); Jiancheng Zhang, Los Altos Hills, CA (US); Sehat Sutardja, Los Altos Hills, CA (US)

(73) Assignee: Marvell International Ltd., Hamilton (BM)

( * ) Notice: Subject to any disclaimer, the term of this patent is extended or adjusted under 35 U.S.C. 154(b) by 262 days.

(21) Appl. No.: 10/619,858

(22) Filed: Jul. 15, 2003

Related U.S. Application Data

(60) Provisional application No. 60/436,079, filed on Dec. 23, 2002.

(51) Int. Cl.[7] ..... G05F 1/56
(52) U.S. Cl. ..... 323/280
(58) Field of Search ..... 323/273, 280

(56) References Cited

U.S. PATENT DOCUMENTS 5,168,209 A 12/1992 Thiel, V ..... 323/313
5,552,697 A 9/1996 Chan ..... 323/282
5,563,501 A 10/1996 Chan ..... 323/282
5,731,739 A * 3/1998 Ho ..... 330/253
5,834,976 A * 11/1998 Tomasini et al. ..... 330/292
5,990,748 A * 11/1999 Tomasini et al. ..... 330/292
6,246,221 B1 6/2001 Xi ..... 323/280
6,373,233 B2 4/2002 Bakker et al. ..... 323/282

OTHER PUBLICATIONS

Bhupendra K. Ahuja; "An Improved Frequency Compensation Technique for CMOS Operational Amplifiers"; IEEE Journal of Solid-State Circuits, vol. SC-18, No. 6, Dec. 1983, pp. 629-633.

Paul R. Gray/Robert G. Meyer; "MOS Operational Amplifier Design—A Tutorial Overview"; IEEE Journal of Solid-State Circuits, vol. SC-17, No. 6, Dec. 1982; pp. 969-982.

* cited by examiner

*Primary Examiner*—Jeffrey Sterrett

(57) ABSTRACT

A voltage regulator apparatus includes an error amplifier that amplifies a voltage difference between a reference and a sampled output voltage of the voltage regulator apparatus. A driver amplifier has an input that is responsive to the amplified voltage difference to produce a gate driving voltage at its output. An output transistor having a drain, a gate, and a source is also included. The gate is responsive to the gate driving voltage to produce a regulated output voltage at the source. To stabilize the voltage regulator apparatus, a Miller compensation capacitor is provided to feed a sample of the regulated output voltage back to the input of the driver amplifier; and additionally, an Ahuja compensation circuit is provided to feed back a portion of the regulated output voltage back to the input of the driver amplifier.

36 Claims, 6 Drawing Sheets

COMPENSATION FOR LOW DROP OUT VOLTAGE REGULATOR

CROSS-REFERENCE TO RELATED APPLICATIONS

This application claims the benefit of U.S. Provisional Application Ser. No. 60/436,079, filed on Dec. 23, 2002, which is hereby incorporated by reference in its entirety.

FIELD OF THE INVENTION

The present invention relates to voltage regulators, and more particularly to compensation for voltage regulators.

BACKGROUND OF THE INVENTION

Referring now to FIG. 1, a low drop-out (LDO) voltage regulator 10 includes an error amplifier 12, a transistor 14, and a voltage divider including resistors $R_1$, $R_2$. An output voltage of voltage regulator 10 is controlled by a feedback connection $V_{FB}$. A reference voltage $V_{REF}$ and a resistive ratio of resistors $R_1$ and $R_2$ determine the value of the output voltage. Transistor 14 may be a PMOS transistor, which provides the required load current.

A minimum permissible drop out voltage defines the maximum efficiency of the voltage regulator 10. The minimum drop out voltage of voltage regulator 10 is proportional to a minimum overdrive voltage that is required to keep transistor 14 in saturation. Lower drop-out voltages tend to decrease the stability of voltage regulator 10, because a lower drop out voltage requires the use of a larger transistors 14 with both a higher gate parasitic capacitance $C_{par}$ and a higher transconductance $g_m$. Larger transistors are also required to accommodate higher maximum load currents, which increases driver amplifier load capacitance $C_{par}$. For example, $C_{par}$ may be in the range of 400 pF to 800 pF in this application.

At least two low frequency poles must be considered when the frequency response of voltage regulator 10 is evaluated. One pole is located at output $V_{OUT}$ of voltage regulator 10 and the other pole is located at gate 16 of transistor 14. A phase margin of a feedback loop including error amplifier 12, transistor 14, and voltage divider $R_1$ and $R_2$ can become negative when other parasitic poles are close to two low frequency poles, which may cause the feedback loop to be unstable. The impedance seen from a drain 18 of transistor 14 is high under light load conditions (i.e., relatively large $R_L$) and is inversely proportional to the load current. The output pole is not isolated from the loading conditions.

The output pole cannot be made dominant because it varies widely with the load current through $R_L$ (from 0 to 800 mA in this application) and load capacitance $C_L$ (from 2 $\mu$F up to 100 $\mu$F in this application). The situation may worsen if voltage regulator 10 drives a purely resistive load. For example, if the load resistance is 10 ohms and the load capacitance is 2 $\mu$F, then the load pole is located at about 8 kHz. Thus, for an open loop gain of 500, the system gain bandwidth will increase to 4 MHz. This gain bandwidth is very high and requires a relatively high current in the error amplifier and/or buffer between it and the pass device. Otherwise, the pole introduced by the capacitance of gate 16 of the transistor 14 will decrease the system phase margin. For load capacitor compensation (external compensation), the loop gain cannot be too high (typically, total voltage regulator 10 open loop gain is around 400 to 500), but lower open loop gain provides correspondingly worse load and line regulation.

Miller compensation can be used to provide increased stability of voltage regulator 10. Referring now to FIG. 2, a driver amplifier 20 with an inner loop or feedback path including Miller capacitor $C_m$ is inserted between output 22 of error amplifier and gate 16 of transistor 14. Driver amplifier 20 is a high bandwidth buffer with low output impedance and a selected gain. Driver amplifier 20 increases the efficiency of Miller compensation by boosting the effective transconductance of transistor 14 to $A_1 g_{mL}$, and also helps to overcome the effect of large capacitance $C_g$ at gate 16 of transistor 14 on pole splitting.

Voltage regulator 10A thus has two loops or feedback paths. The first is an outer loop 24 from a positive input 26 of error amplifier 12 to an input 28 of driver amplifier 20 to gate 16 of transistor 14, and closed through drain 18 of transistor 14 and $R_2$. A second, inner loop 30 from $V_{OUT1}$ to gate 36 of transistor 14 is closed through drain 18 of transistor 14 and Miller capacitor $C_M$. For voltage regulator 10A to be stable, both inner loop 30 and outer loop 24 must be stable.

More particularly, with respect to outer loop 24, the dominant pole at $V_{out1}$ is at $$\omega_{P1}=1/(r_0 A_1 g_{mL} r_L C_m) \tag{1}$$

the second pole at $V_{out}$ is at:

$$\omega_{P2}=A_1 g_{mL}/C_L \tag{2}$$

and the third pole at $V_{ga}$ is at:

$$\omega_{P3}=1/(r_1 C_g). \tag{3}$$

Miller compensation introduces a zero:

$$\omega_{Zm}=-A_1 g_{mL}/C_m. \tag{4}$$

There are high frequency poles and zeros in driver amplifier 20. The transfer function from $V_{REF}$ to $V_{OUT}$ is:

$$A_v(s)=A_0*(1-s/\omega_{Zm})/[(1+s/\omega_{P1})(1+s/\omega_{P2})(1+s/\omega_{P3})], \tag{5}$$

where $A_0=g_{m0} r_0 A_1 g_{mL} r_L$, is the total open loop gain of the voltage regulator. Let $\omega_u$ represent the unity gain bandwidth frequency and $\omega_t$ the gain bandwidth, $A_0\omega_d$. Then for a two-pole system, the unity gain-bandwidth and phase margin (PM) relationship is:

$$\omega_u=\omega_t \sin(PM) \tag{6}$$

or $$\omega_u=\omega_{P2}/\tan(PM). \tag{7}$$

The zero due to Miller compensation is located at a very high frequency. If it is assumed that the third pole is located at relatively high frequency with respect to the unity gain bandwidth, outer loop 24 can be treated as a two-pole system. The gain bandwidth is written:

$$\omega_t=A_0\omega_{P1}=g_{m0}/(2\omega C_m) \tag{8}$$

From equations (6) and (8), the unity gain bandwidth is given by:

$$\omega_u=g_{m0} \sin(PM)/C_m \tag{9}$$

The relation between second pole position, unity gain bandwidth and phase margin can be obtained from eq. (2), (7) and (9):

$$A_1 g_{mL}/C_L = g_{m0} \sin(PM) \tan(PM)/C_m \quad (10)$$

Thus, the gain of the driver amplifier 20 can be estimated for a given load condition, compensation and load capacitances and loop phase margin.

A high gain bandwidth driver amplifier is needed to maintain a reasonable phase margin of the outer loop. For a given load capacitance $C_L$, doubling the gain of driver amplifier 20 will double the gain bandwidth. The output impedance of driver amplifier 20 must be reduced by half to keep the same phase margin. At the same time all parasitic poles and zeros in driver amplifier 20 must be pushed to higher frequencies.

With respect to inner loop 30 stability, the inner loop has a pole at $V_{out1}$:

$$\omega_{P1} = 1/(r_0 C_m), \quad (11)$$

a pole at $V_{out}$:

$$\omega_{P2} = 1/(r_L C_L), \quad (12)$$

and a pole at $V_{ga}$:

$$\omega_{P3} = 1/(r_1 C_g) \quad (13)$$

There is a zero located at zero frequency due to the AC coupling. Since $A_1$ is in inner loop 30, the poles and zeros in driver amplifier 20 are also in inner loop 30. We assume these poles are located at very high frequencies. Because inner loop 30 is AC coupled, it does not participate in any DC activity. The loop gain of inner loop 30 will go up with increasing frequency as a result of the AC-coupling zero. In the frequency range of pole P1, the gain becomes flat. The gain in this frequency range is:

$$A'_0 = A_1 g_{mL} r_L \quad (14)$$

Inner loop 30 starts to participate from this point, in the sense that the pole at frequency $\omega_{P2}$ is a dominant pole of inner loop 30. The maximum gain of the inner loop is $A'_0$, which can be reached if pole frequencies $\omega_{P1}$ and $\omega_{P2}$ are sufficiently separated. The gain bandwidth product is:

$$\omega'_t = A_1 g_{mL}/C_L \quad (15)$$

Eq. (15) indicates that the gain bandwidth product of inner loop 30 is the second pole of outer loop 24. Higher $A_1$ and $g_{mL}$, and lower $C_L$ make inner loop 30 more difficult to stabilize.

From the analysis of standard Miller compensation, it is known that to make voltage regulators 10 or 10A stable, it is necessary for gain $A_1$ to be high and/or the value of $g_{mL}$ large. At the same time, it is necessary to push the gate pole of transistor 14 to a high frequency, to make the output impedance of driver amplifier 20 low enough. However, it is difficult to design a high gain, low impedance driver amplifier 20 with low power consumption.

Ahuja compensation can be used to increase the stability of inner loop 30. This stability is achieved by pushing the load pole to a higher frequency by the ratio of capacitive gain $C_a/C_p$, keeping the other pole positions in outer loop 24 unchanged.

Referring now to FIG. 3, there is a dominant pole at $V_{out1}$ at a frequency:

$$\omega_{P1} = 1/(r_0 A_1 g_{mL} r_L C_a) \quad (16)$$

There is a second pole at $V_{out}$ at a frequency:

$$\omega_{P2} = (C_a/C_p)^* A_1 g_{mL}/C_L \quad (17)$$

There is also a third pole at $V_{ga}$ at a frequency:

$$\omega_{P3} = 1/(r_1 C_g) \quad (18)$$

Ahuja compensation introduces a zero-pole pair, each canceling the other:

$$\omega_{Za}, \omega_{Pa} = g_{ma}/C_a \quad (19)$$

If the high frequency poles and zeros in driver amplifier 20 are ignored, the transfer function of voltage regulator 10B is written:

$$A_v(s) = A_0/[(1+s/\omega_{P1})(1+s/\omega_{P2})(1+s/\omega_{P3})] \quad (20)$$

Similarly to Miller compensation, the third pole due to pass device gate capacitor $C_g$ can be pushed to relatively high frequency. The outer loop gain bandwidth is written:

$$\omega_t = g_{m0}/C_a \quad (21)$$

The gain bandwidth obtained using Ahuja compensation is the same as that obtained using Miller compensation, but the second pole in Ahuja compensation is larger by the ratio of $(C_a/C_p)$. Therefore for the same phase margin, the required gain $A_1$ of driver amplifier 20 can be reduced.

One might hope that the reduction in $A_1$ by capacitive gain would make the design of driver amplifier 20 easier. However, the effects of $C_a$ and $C_p$ on inner loop 30 stability must be taken into account. Referring to a simplified circuit 32 shown in FIG. 4, the transfer function from $V_{IN}$ to $V_{OUT}$ can be written:

$$V_{OUT}/V_{IN} = g_{ma} s C_a/[(sC_a + g_{ma} + g_{dw})(sC_p + g_{up})] \quad (22)$$

There are two poles and one zero in this circuit. The zero is located at DC because of AC coupling. One pole is formed by $C_P$ and $r_{up}$, and the other pole is introduced by Ahuja compensation. In the present case, $g_{ma} >> g_{dw}$ and $g_{up}$. From eq. (22), it is apparent that the gain of the circuit represented in FIG. 4 will keep increasing with frequency up to the frequency range of the pole formed by $C_p$ and $r_{up}$. Thus $C_p$ cannot be made too small, otherwise the gain will be too large, making the loop more difficult to stabilize. If, in a frequency range of interest, $SC_p >> g_{up}$, then eq. (22) can be reduced to:

$$V_{OUT}/V_{IN} = (C_a/C_p)^* g_{ma}/(sC_a + g_{ma}) \quad (23)$$

The same amount of capacitive gain, $(C_a/C_p)$, appears in inner loop 30. Thus, in agreement with the Miller compensation case, the gain bandwidth product of the inner loop is the same as the second pole location of the outer loop. Ahuja compensation creates a new pole in inner loop 30. The new pole is located at:

$$\omega_a = g_{ma}/C_a \quad (24)$$

In addition to the load pole and the gate 16 pole of transistor 14, inner loop 30 is a three-pole system. Normally the frequency position of the pole $\omega_a$ is below that of the gate 16 pole of transistor 14. To have a stable circuit 10B, this pole must either by moved to a higher frequency or be canceled by a zero. To move this pole to a much higher frequency, for example, in the range of 10 to 100 MHz, $g_{ma}$ might be made very large. Although making $g_{ma}$ larger does, in fact, work in this regard, this approach requires both additional circuits and more power to operate the additional circuits.

In summary, inner loop 30 has a pole at $V_{out1}$ at frequency:

$$\omega_{P1}=1/(r_0C_p), \quad (25)$$

a pole at $V_{out}$:

$$\omega_{P2}=1/(r_LC_L), \quad (26)$$

a pole at $V_a$:

$$\omega_{P3}=g_{ma}/C_a, \quad (27)$$

and a pole at $V_{ga}$:

$$\omega_{P4}=1/(r_1C_g). \quad (28)$$

As in the Miller compensation case, AC coupling capacitor $C_a$ introduces a zero at zero frequency. There are also poles and zeros in driver amplifier 20 that should be placed at very high frequencies. To make inner loop 30 stable, parasitic capacitance $C_p$ cannot be very small, as it is used to cancel the AC-coupling zero. If $C_p$ is small, inner loop 30 will have high gain in the frequency range of the P1 pole. For a given pole P2 position, the P4 pole has to be placed at a higher frequency, thus making the design of driver amplifier 20 considerably more difficult. Inner loop 30 will be unstable even for relatively small capacitive gain ($C_a/C_p$) due to the existence of the third pole P3.

SUMMARY OF THE INVENTION

A voltage regulator apparatus includes an error amplifier that amplifies a voltage difference between a reference and a sampled output voltage of the voltage regulator apparatus. A driver amplifier has an input that is responsive to the amplified voltage difference to produce a gate driving voltage at its output. An output transistor has a drain, a gate, and a source. The gate is responsive to the gate driving voltage to produce a regulated output voltage at the source of the output transistor. To stabilize the voltage regulator apparatus, a Miller compensation capacitor feeds the regulated output voltage back to the input of the driver amplifier. An Ahuja compensation circuit feeds the regulated output voltage back to the input of the driver amplifier.

Circuit component values are selected so that a zero resulting from the Miller compensation capacitor at least partially cancels a pole resulting from the Ahuja compensation.

In other configurations, a voltage regulator has an outer loop and an inner loop. The outer loop includes an error amplifier having an output that communicates with an input of a driver amplifier and a regulated voltage output that communicates with an output of the driver amplifier. The outer loop further includes an outer feedback path from the regulated voltage output to an input of the error amplifier that maintains the regulated voltage output in accordance with a reference voltage. The voltage regulator also includes an inner loop. The inner loop includes a first feedback path and a second feedback path around the driver amplifier. In the inner loop, a zero produced by the first feedback path at least partially cancels a pole produced by the second feedback path. Also, in some configurations, the first feedback path includes a Miller compensation capacitor and the second feedback path includes an Ahuja compensation circuit.

Yet other configurations provide a method for regulating voltage. The method includes comparing a sampled DC voltage to a reference voltage to generate a correction signal, amplifying the correction signal utilizing a driver amplifier, and controlling a gate voltage of a pass transistor utilizing the amplified correction signal to generate a regulated output voltage. The sampled DC voltage is related to the regulated output voltage. The method also includes feeding back a first portion of the regulated output voltage to the driver amplifier utilizing a Miller compensation capacitor and feeding back a second portion of the regulated output voltage to the driver amplifier utilizing an Ahuja compensation circuit.

The interaction of poles and zeros provided by the combination of two feedback paths in a single voltage regulator voltage regulator advantageously simplifies the design of the voltage regulator, at least in part by easing driver amplifier requirements for high gain, low impedance and low power consumption. More particularly, in some configurations, at least one zero introduced by one of the feedback paths is used to cancel a pole introduced by the other to increase stability of the voltage regulator.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

As used herein, "Miller effect" refers to the use of feedback capacitance to lower an input pole frequency. "Miller compensation" refers to a feedback topology in which a "Miller feedback capacitor" (or "Miller capacitor") provides feedback to the input of an amplifier from a later stage, such as the output of the amplifier, or the output of the amplifier as further buffered and/or amplified. Miller compensation makes a system's open loop transfer function approximate simple first order dynamics over a wide range by creating a dominant pole.

As used herein, an "Ahuja compensation circuit" refers to a feedback topology that includes an "Ahuja feedback capacitor" (or "Ahuja capacitor") providing feedback to the input of an amplifier from a later stage, such as the output of the amplifier or the output as further buffered and/or amplified. However, unlike Miller compensation, the Ahuja capacitor feeds back to a node joining a first current source and a source of a transistor. The input of the amplifier compensated by the Ahuja compensation circuit is at a node joining a drain of the transistor and a second current source.

Figure 5:
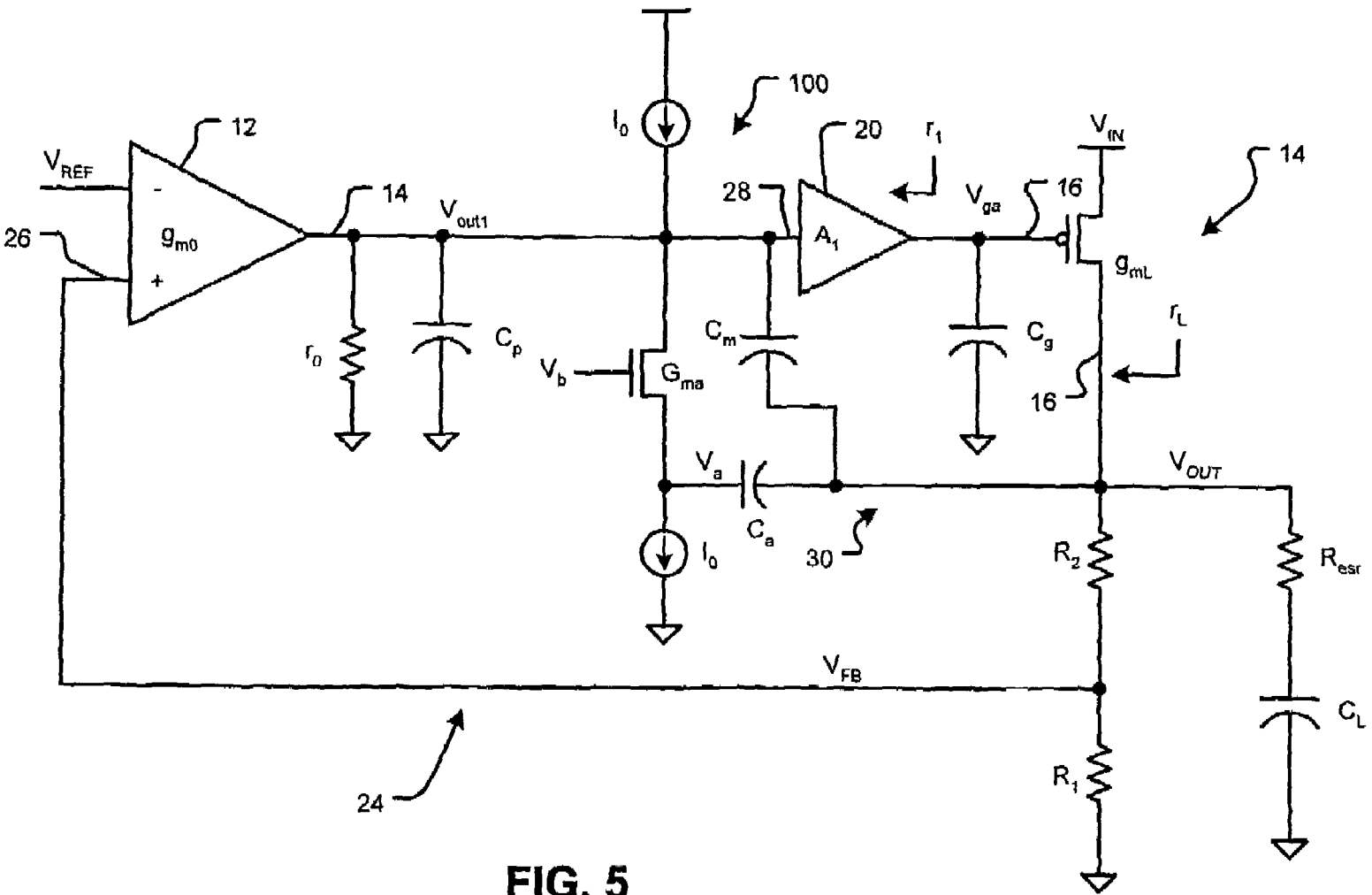
FIG. 5 is a schematic diagram representative of LDO voltage regulator configurations of the present invention incorporating both Miller compensation and Ahuja compensation.

Referring now to FIG. 5, to cancel the effect of the third pole P3 in Ahuja compensation, both Ahuja and Miller compensation are used. A left half-plane (LHP) zero is created by this mixed frequency compensation. The LHP zero effectively cancels pole P3 and compensates the phase of inner loop 30. Miller compensation capacitor $C_m$ and Ahuja compensation capacitor $C_a$ are used for frequency compensation. Inner loop analysis shows that a LHP zero is created by this configuration, which tracks the pole introduced by Ahuja compensation. The net effect of this zero is to cancel the pole and compensate the phase. The values of $C_m$, $C_a$ and its ratio are selected in accordance with outer loop 24 and inner loop 30 stability requirements.

The dominant pole of the outer loop at $V_{out1}$ is at a frequency:

$$\omega_{P1}=1/[r_0A_1g_{mL}r_L(C_a+C_m)], \tag{29}$$

the second pole at $V_{out}$ is at:

$$\omega_{P2}=(C_a/C_m)*A_1g_{mL}/C_L, \tag{30}$$

and the third pole at $V_{ga}$ is at:

$$\omega_{P3}=1/(r_1C_g). \tag{31}$$

Ahuja compensation introduces a zero-pole pair in which the zero and pole cancel one another:

$$\omega_{Za},\ \omega_{Pa}=g_{ma}/C_a. \tag{32}$$

Miller compensation introduces a zero at:

$$\omega_{Zm}=-g_{mL}/C_m. \tag{33}$$

Outer loop 24 can be treated approximately as a two-pole system as in both the Miller compensation and Ahuja compensation cases. More specifically, $\omega_{Zm}$ and $\omega_{P3}$ are a high frequency zero and pole, respectively, so that their effects can be ignored in the analysis of outer loop 24. The gain bandwidth product is given by:

$$\omega_t=g_{m0}/(C_a+C_m), \tag{34}$$

and the unity gain bandwidth is:

$$\omega_u=g_{m0}\sin(PM)/(C_a+C_m) \tag{35}$$

Driver amplifier 20 gain $A_1$ can be obtained from an expression written:

$$(C_a/C_m)A_1g_{mL}/C_L=g_{m0}\sin(PM)\tan(PM)/C_m, \tag{36}$$

where PM is a specified phase margin.

Figure 1:
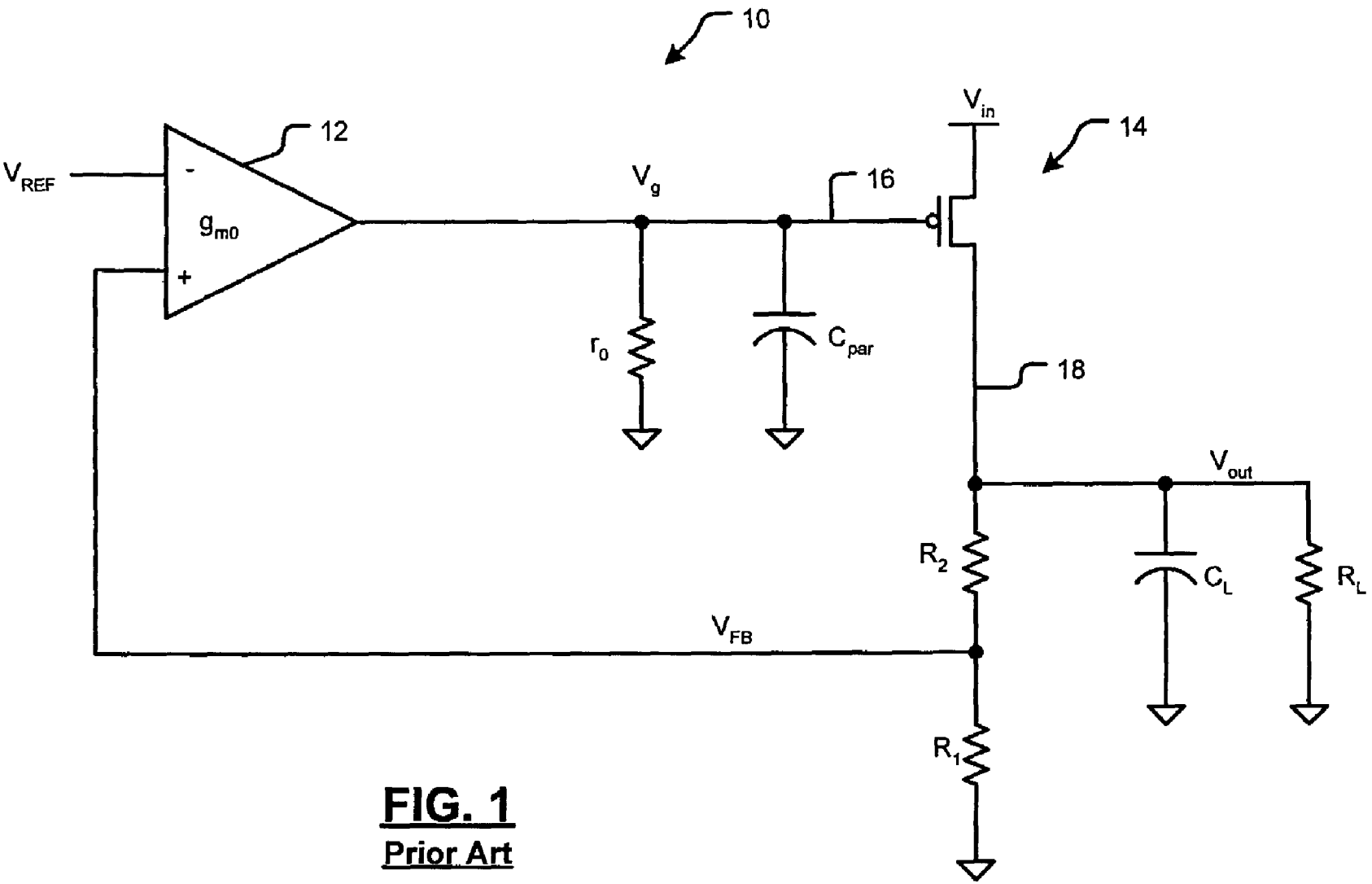
FIG. 1 Prior Art
FIG. 1 is a schematic diagram of a prior art low drop-out (LDO) voltage regulator.
Figure 2:
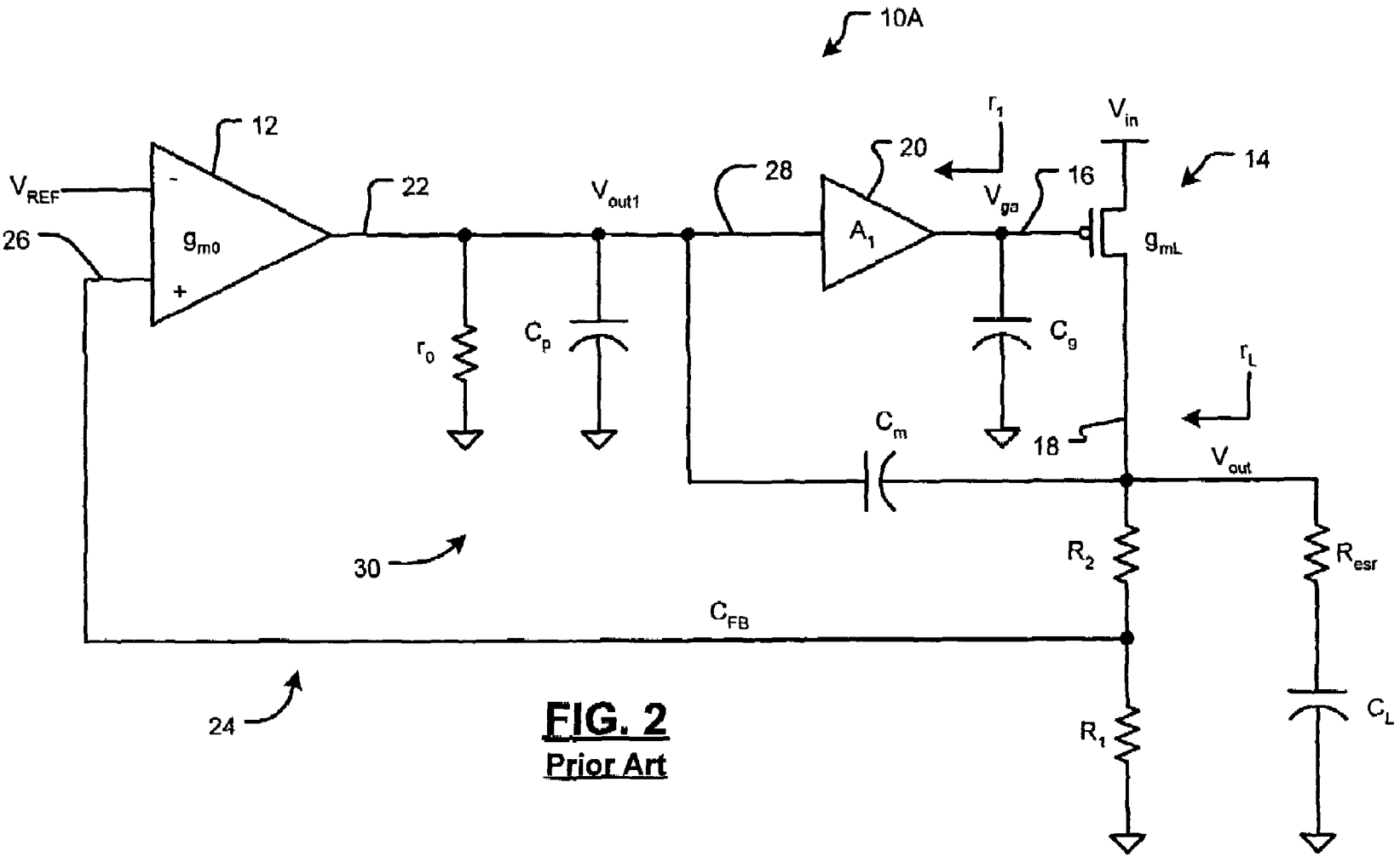
FIG. 2 Prior Art
FIG. 2 is a schematic diagram of a prior art LDO voltage regulator utilizing Miller compensation.
Figure 3:
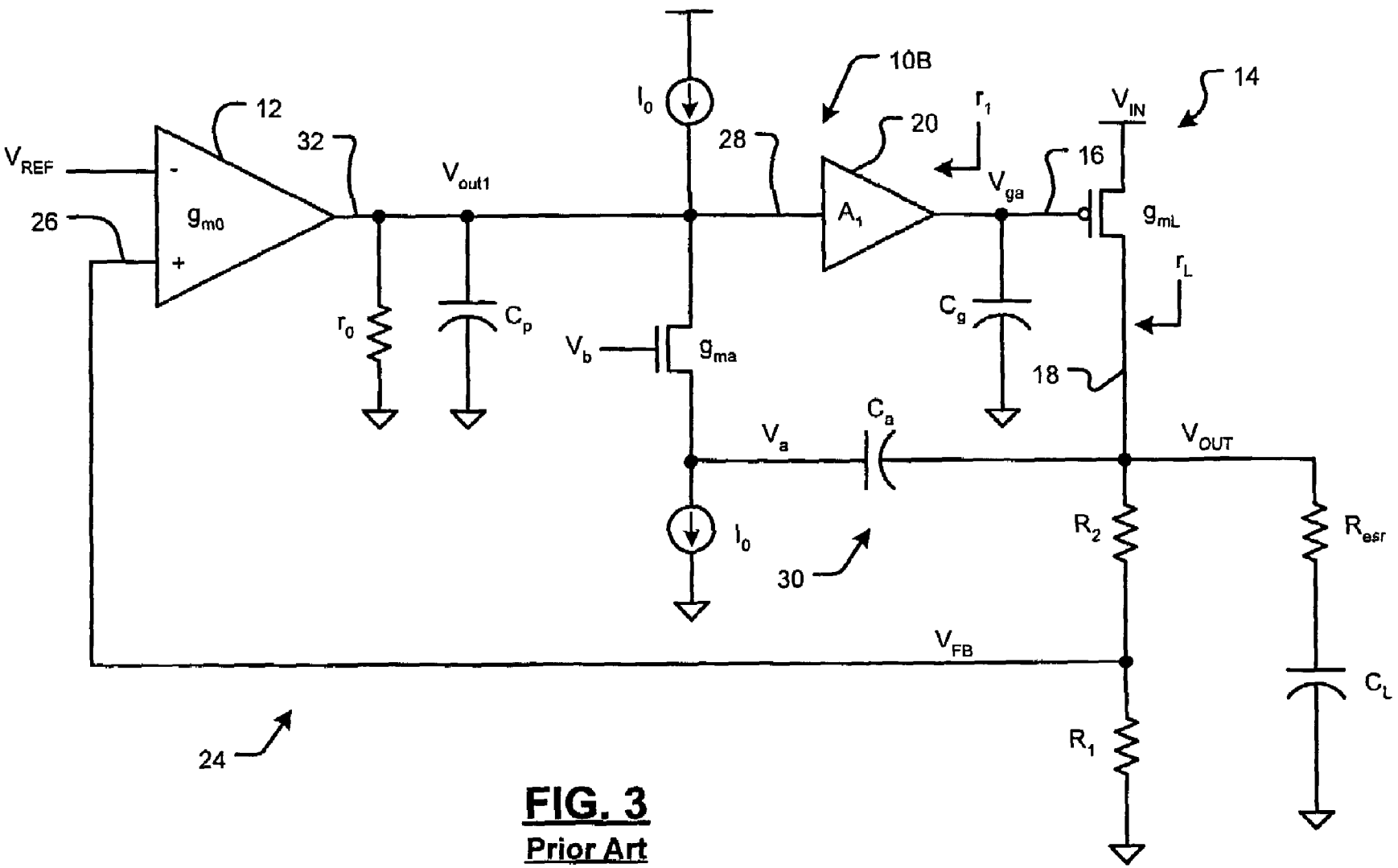
FIG. 3 Prior Art
FIG. 3 is a schematic diagram of a prior art LDO voltage regulator utilizing Ahuja compensation.
Figure 6:
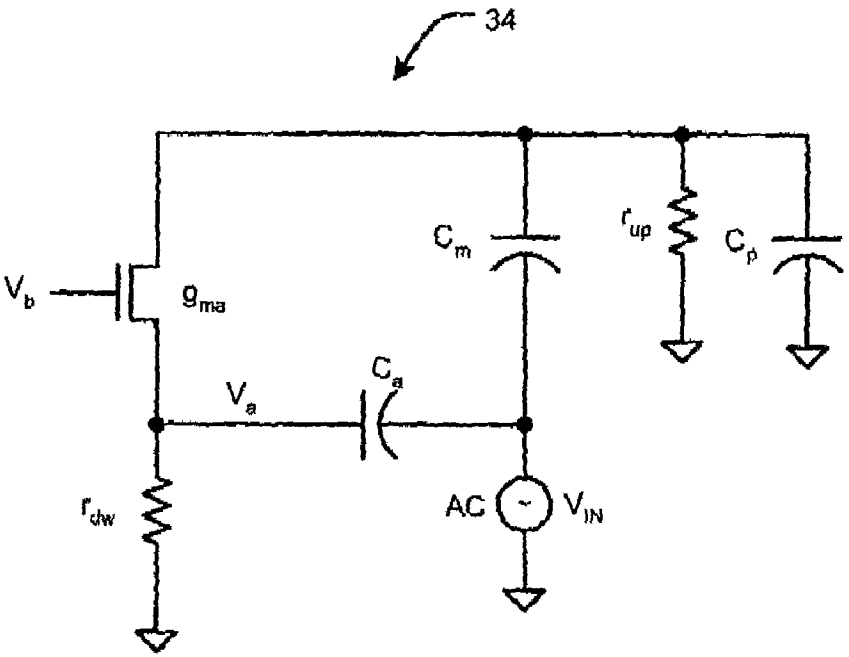
FIG. 6 is a schematic diagram of a simplified circuit for the inner loop analysis of combined Miller and Ahuja compensation.
Figure 4:
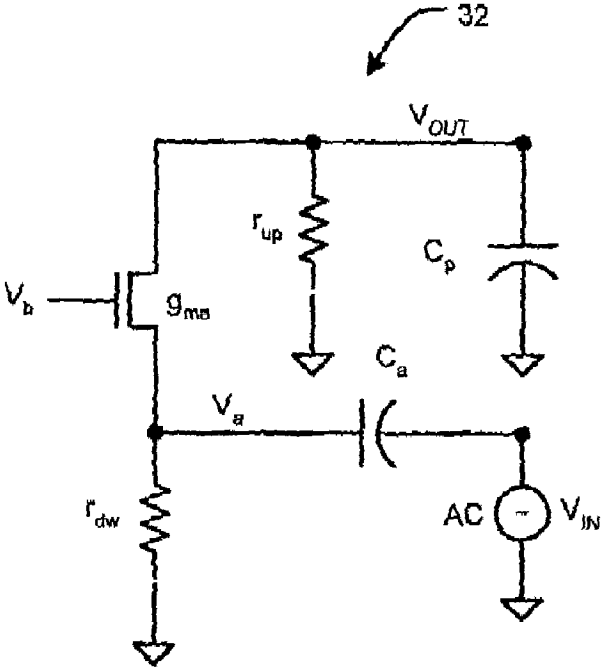
FIG. 4 is a schematic diagram of a simplified circuit for the inner loop analysis of Ahuja compensation.

To determine the stability of inner loop 24, a simplified circuit 34 in FIG. 6 is provided. The transfer function from $V_{IN}$ to $V_{OUT}$ can be written:

$$V_{OUT}/V_{IN}=[(s^2C_aC_m+g_{ma}sC_a+(g_{ma}+g_{dw})sC_m]/[(sC_a+g_{ma}+g_{dw})(sC_m+g_{up})] \tag{37}$$

There are two poles and two zeros in this system. The transfer function can be simplified if $g_{ma}>>g_{dw}$:

$$V_{OUT}/V_{IN}=[(sC_a/(sC_m+g_{up})]*[sC_m+g_{ma}(C_m+C_a)/C_a]/(sC_a+g_{ma}) \tag{38}$$

From eq. (38), the pole and zero frequencies are:

$$\omega_{P1}=1/(r_{up}C_m) \tag{39}$$

$$\omega_{P2}=g_{ma}/C_a \tag{40}$$

$$\omega_{Z1}=0 \tag{41}$$

$$\omega_{Z2}=(1+C_a/C_m)*g_{ma}/C_a \tag{42}$$

where $\omega_{Z2}$ is a left hand plane zero located at higher frequency than $\omega_{P2}$ by the factor of $(1+C_a/C_m)$. The maximum gain of the loop is $(1+C_a/C_m)$.

The inner loop 30 pole at $V_{out1}$ is found at:

$$\omega_{P1}=1/(r_0C_m), \tag{43}$$

the pole at $V_{out}$ is at:

$$\omega_{P2}=1/(r_LC_L), \tag{44}$$

the pole at $V_a$ is at:

$$\omega_{P3}=g_{ma}/C_a, \tag{45}$$

and the pole at $V_{ga}$ is at:

$$\omega_{P4}=1/(r_1C_g). \tag{46}$$

There are also zeros at DC and at the frequency:

$$\omega_Z=(1+C_a/C_m)*g_{ma}/C_a \tag{47}$$

The LHP zero can partially cancel the pole at frequency $\omega_{P3}$ due to Ahuja compensation if these two are not far away from each other. The Ahuja capacitor and the Miller capacitor may be selected so that the LHP zero and the pole at $\omega_{P3}$ at least partially compensate one another. The LHP zero also compensates inner loop 30 phase, thus providing additional stability.

$$A_{0,max}=A_1g_{mL}r_L(1+C_a/C_m) \tag{48}$$

The capacitive gain $(1+C_a/C_m)$ cannot be too large, otherwise it is difficult to make inner loop 30 stable. In some configurations, the ratio $C_a/C_m$ is less than about 3. The frequency response and phase margin are determined mainly by frequencies $\omega_{P2}$, $\omega_{P3}$, $\omega_{P4}$ and $\omega_Z$. For given load conditions, the ratio of $C_a$ and $C_m$, and $A_1$, the output impedance of the driver amplifier can be estimated by the following equation:

$$r_1=(C_L/A_1g_{mL}C_g)/(1+C_a/C_m) \tag{49}$$

For example, consider a configuration in which $I_{load}=0\ \mu A$ and $I_{dc}=100\ \mu A$, as this is the worst case configuration for stability of outer loop 24. For this configuration, choose $C_L=20\ \mu F$, $C_a=20$ pF, $C_m=8$ pF and $C_g=500$ pF. Also, $g_{m0}=1.2\ \mu S$ and $g_{mL}=2.4$ mS. Using eq. (36), the required $A_1$ of driver amplifier 20 for outer loop phase margin equal to 20° is:

$$A_1=(g_{m0}/g_{mL})*(C_L/(C_m+C_a))*(C_m/C_a)*\sin(PM)*\tan(PM)=17.$$

The output impedance of driver amplifier 20 can be estimated using eq. (49). The value $g_{mL}=4.9$ S is used for load current $I_{load}=800$ mA case. Thus, r1=137 Ω.

Equivalent series resistance (ESR) introduces a LHP zero at $1/(2\pi r_{esr}C_L)$. In some configurations, the ESR is in the range of few tens of mini-ohms. Some configurations of the present invention, however, handle ESRs up to 1 ohm. The ESR zero can improve the outer loop 24 phase margin. However the ESR zero also appears in inner loop 30, where it expands the inner loop 30 bandwidth to higher frequency. The inner loop gain becomes flat in the frequency range of the ESR zero, and the next pole located at higher frequency brings it down. If driver amplifier 20 output impedance is very small, the gate 16 pole will be located at a relatively high frequency. Then loop bandwidth will be pushed to close to the parasitic poles of driver amplifier 20. The inner loop 30 phase margin will become negative. Thus, ESR can result in stability problems for voltage regulator 100. The output impedance of driver amplifier 20, capacitive gain factor $C_a/C_m$, and inner loop 30 phase margin are functions of the ESR, and thus, these parameters should be selected in accordance with the process technology used and the required ESR range.

Figure 7:
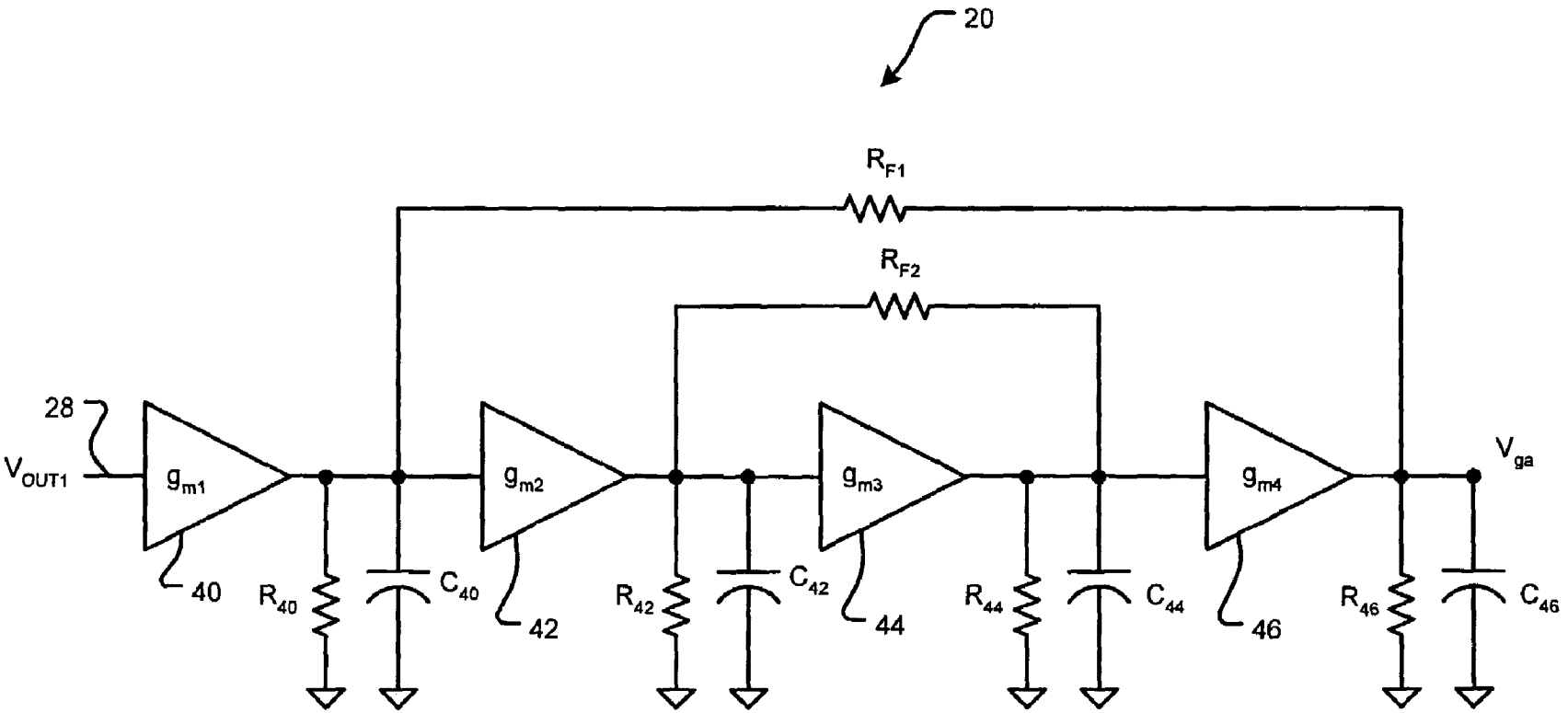
FIG. 7 is a schematic diagram representative of various configurations of driver amplifier suitable for use as the driver amplifier in some configurations of LDO voltage regulators of the present invention.

Referring now to FIG. 7, driver amplifier 20 may be a wide band amplifier, which provides a gain of about 18 along with low output impedance (about 100 to 200 Ω). A nested structure is used to lower the output impedance of amplifier 20. The nested structure in some configurations includes four series-connected amplifiers 40, 42, 44, and 46. A feedback resistance $R_{F1}$ is located between an output of the fourth amplifier 46 and an input of the second amplifier 42. Another feedback resistance $R_{F2}$ is located between an output of the third amplifier 44 and its input. The gain and output impedance of amplifier 20 are written:

$$A_1=g_{m1}R_{F1} \tag{50}$$

and $$Z_{out}=1/(g_{m2}R_{F2}g_{m4}), \tag{51}$$

respectively. The gain and the output impedance of amplifier 20 can be changed separately and efficiently by selecting resistor values $R_{F1}$, $R_{F2}$ and $g_{m1}$, $g_{m2}$, $g_{m3}$, and $g_{m4}$. However, these values cannot be made too large, otherwise the parasitic poles and zeros associated with these resistors go to low frequencies too close to the gate 16 pole. The output impedance selected should not be too low, as there has to be some amount of separation in frequency between gate 16 pole and parasitic poles to make voltage regulator 100 inner loop 30 stable in the presence of 1 Ω ESR.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, the specification and the following claims.

What is claimed is:

1. A voltage regulator, comprising:

an error amplifier that amplifies a voltage difference between a reference voltage and a sampled output voltage of the voltage regulator;

a driver amplifier that receives said amplified voltage difference and that produces a gate driving voltage;

an output transistor that has a gate that receives said gate driving voltage and a source that outputs a regulated output voltage;

a Miller compensation capacitor that feeds a sample of said regulated output voltage back to an input of said driver amplifier; and an Ahuja compensation circuit that feeds a portion of said regulated output voltage back to said input of said driver amplifier.

2. The voltage regulator of claim 1 wherein a zero resulting from said Miller compensation capacitor at least partially cancels a pole resulting from said Ahuja compensation circuit.

3. The voltage regulator of claim 2 wherein said zero produced by said Miller compensation capacitor tracks said pole produced by said Ahuja compensation circuit.

4. The voltage regulator of claim 2 wherein a frequency of said zero produced by said Miller compensation capacitor is within a capacitive gain factor of a frequency of said pole produced by said Ahuja compensation circuit.

5. The voltage regulator of claim 4 wherein said Ahuja compensation circuit includes an Ahuja feedback capacitor and wherein said capacitive gain factor is equal to one plus a ratio of a value of said Ahuja feedback capacitor divided by a value of said Miller compensation capacitor.

6. The voltage regulator of claim 2 wherein said Ahuja compensation circuit includes an Ahuja feedback capacitor, and wherein a ratio of said Ahuja feedback capacitor and said Miller compensation capacitor is less than about 3.

7. The voltage regulator of claim 1 wherein said driver amplifier comprises a plurality of series-connected amplifiers.

8. The voltage regulator of claim 7 wherein said driver amplifier comprises four series-connected amplifiers.

9. The voltage regulator of claim 8 wherein said voltage regulator having at least two nested feedback paths.

10. The voltage regulator of claim 1 wherein said error amplifier comprises a P-channel input differential pair amplifier.

11. The voltage regulator of claim 1 wherein said output transistor is a power P-channel MOSFET.

12. The voltage regulator of claim 1 wherein said driver amplifier has an output impedance of between about 100 Ω and 200 Ω.

13. A voltage regulator apparatus comprising:

an outer loop including an error amplifier having an output that communicates with an input of a driver amplifier, a regulated voltage output responsive to an output of said driver amplifier, and an outer feedback path from said regulated voltage output to an input of said error amplifier that maintains said regulated voltage output based on a reference voltage;

an inner loop including a first feedback path and a second feedback path around said driver amplifier, wherein said first and second feedback paths do not include said error amplifier, and wherein a zero produced by said first feedback path at least partially cancels, in said inner loop, a pole produced by said second feedback path.

14. The voltage regulator apparatus of claim 13 wherein said first feedback path includes a Miller compensation capacitor ($C_m$) and said second feedback path includes an Ahuja compensation circuit.

15. The voltage regulator of claim 14 wherein said Ahuja compensation circuit includes an Ahuja feedback capacitor ($C_a$), and wherein a ratio of said Ahuja feedback capacitor and said Miller compensation capacitor is less than about 3.

16. The voltage regulator of claim 15 wherein said pole and said zero are within a capacitive gain factor of (1+Ca/Cm).

17. A method for regulating voltage comprising:

comparing a sampled DC voltage to a reference voltage to generate a correction signal;

amplifying the correction signal utilizing a driver amplifier;

generating a regulated output voltage based on said amplified correction signal, wherein said sampled DC voltage is related to said regulated output voltage;

feeding back said regulated output voltage to said driver amplifier utilizing Miller compensation; and feeding back said regulated output voltage to said driver amplifier utilizing Ahuja compensation.

18. The method of claim 17 further comprising selecting a Miller compensation capacitor ($C_m$) and an Ahuja feedback capacitor ($C_a$) so that a zero resulting from said Miller compensation capacitor at least partially cancels a pole resulting from said Ahuja feedback capacitor.

19. The method of claim 18 wherein a capacitance ratio of said capacitor of said Ahuja compensation circuit to said Miller compensation capacitor is less than about 3.

20. The method of claim 18 wherein said zero frequency is within a factor of 4 of said pole frequency.

21. The method of claim 18 said zero and said pole are within a factor of $(1+C_a/C_m)$.

22. A voltage regulator, comprising:

error amplifying means for amplifying a voltage difference between a reference voltage and a sampled output voltage of the voltage regulator;

driver amplifying means for receiving said amplified voltage difference and for producing a gate driving voltage;

output means for receiving said gate driving voltage and for generating a regulated output voltage;

first compensation means for feeding a sample of said regulated output voltage back to an input of said driver amplifying means; and second compensation means for feeding back a portion of said regulated output voltage back to said input of said driver amplifying means.

23. The voltage regulator of claim 22 wherein a zero resulting from said first compensation means at least partially cancels a pole resulting from said second compensation means.

24. The voltage regulator of claim 23 wherein said zero produced by said first compensation means tracks said pole produced by said second compensation means.

25. The voltage regulator of claim 23 wherein a frequency of said zero produced by said first compensation means is within a factor of (1+Ca/Cm) of a frequency of said pole produced by said second compensation means.

26. The voltage regulator of claim 23 wherein said second compensation means includes an Ahuja feedback capacitor and said first compensation means includes a Miller compensation capacitor, and wherein a ratio of said Ahuja feedback capacitor and said Miller compensation capacitor is less than about 3.

27. The voltage regulator of claim 22 wherein said driver amplifying means has an output impedance of between about 100 Ω and 200 Ω.

28. The voltage regulator of claim 22 wherein said driver amplifying means comprises a plurality of series-connected amplifiers.

29. The voltage regulator of claim 28 wherein said driver amplifying means comprises four series-connected amplifiers.

30. The voltage regulator of claim 29 wherein said voltage regulator includes at least two nested feedback paths.

31. The voltage regulator of claim 22 wherein said error amplifying means comprises a P-channel input differential pair amplifier.

32. The voltage regulator of claim 22 wherein said output means is a power P-channel MOSFET.

33. A method for operating a voltage regulator, comprising:

amplifying a voltage difference between a reference and a sampled output voltage of the voltage regulator;

producing a gate driving voltage based on said amplified voltage difference;

receiving said gate driving voltage and outputting a regulated output voltage;

feeding back a sample of said regulated output voltage to provide Miller compensation; and feeding back a portion of said regulated output voltage to provide Ahuja compensation.

34. The method of claim 33 further comprising partially canceling a zero produced by said Miller compensation using a pole produced by said Ahuja compensation.

35. The method of claim 34 wherein said zero produced by said Miller compensation tracks said pole produced by said Ahuja compensation.

36. The method of claim 34 wherein a frequency of said zero produced by said Miller compensation is within a factor of (1+Ca/Cm) of a frequency of said pole produced by said Ahuja compensation.

* * * * *

UNITED STATES PATENT AND TRADEMARK OFFICE

CERTIFICATE OF CORRECTION

PATENT NO. : 6,977,490 B1
APPLICATION NO. : 10/619858
DATED : December 20, 2005
INVENTOR(S) : Zhang et al.

It is certified that error appears in the above-identified patent and that said Letters Patent is hereby corrected as shown below:

Column 1, Line 33: Delete "transistors" and insert -- transistor --
Column 6, Line 11: Delete "voltage regulator" after "voltage regulator"
Column 11, Line 20: Insert -- wherein -- after "18"

Signed and Sealed this

Nineteenth Day of September, 2006

JON W. DUDAS
*Director of the United States Patent and Trademark Office*